US005217070A

United States Patent [19]

Anderson

[11] Patent Number: 5,217,070

[45] Date of Patent: Jun. 8, 1993

[54] DRILL STRING JARRING AND BUMPING TOOL

[76] Inventor: Clifford J. Anderson, 2007 Fairview Court, Edmonton, Alberta, Canada, T8A 0Y9

[21] Appl. No.: 878,915

[22] Filed: May 6, 1992

[51] Int. Cl.[5] ..... E21B 31/107

[52] U.S. Cl. ..... 166/178; 175/299

[58] Field of Search ..... 166/187; 175/293, 296, 175/298-306

[56] References Cited

U.S. PATENT DOCUMENTS

| | | | |
|---|---|---|---|
| 3,735,828 | 5/1973 | Berryman | 175/299 |
| 4,865,125 | 9/1989 | De Cuir | 175/299 X |
| 4,919,219 | 4/1990 | Taylor | 175/299 |
| 5,022,473 | 6/1991 | Taylor | 175/299 |
| 5,052,485 | 10/1991 | Reid | 175/299 X |

*Primary Examiner*—Thuy M. Bui

*Attorney, Agent, or Firm*—Terry M. Gernstein

[57] ABSTRACT

A jarring and bumping tool is provided, having a mandrel telescopically received within a barrel for relative longitudinal movement. Upper and lower seals form an oil-containing annular space therebetween. The mandrel carries a free-floating annular primary piston which sealably engages a reduced-diameter piston fitting section of the barrel when passing therethrough. The mandrel also carries a secondary cylinder assembly with a transverse top wall and a downwardly extending annular secondary cylinder beneath the primary piston, forming a piston chamber between the mandrel and secondary cylinder assembly. The mandrel also carries a spring which biases a free-floating annular secondary piston upwards into the piston chamber. A port through the top wall of the cylindrical member provides fluid communication between the annular space and the piston chamber. Thus, when the mandrel is pulled upwards the primary piston seals against the piston fitting section, oil in the annular space is compressed and forced through the port and into the piston chamber against the secondary piston to compress the spring, and the drill string is stretched. When the primary piston clears the piston fitting section, fluid moves rapidly around the primary piston, the mandrel extends, and impact faces connect to deliver a jarring stroke upwards.

5 Claims, 6 Drawing Sheets

DRILL STRING JARRING AND BUMPING TOOL

FIELD OF THE INVENTION

This invention relates to a jarring and bumping tool for use in a drill string in a down-hole well. More particularly, it relates to a tool adapted to jar upwards or bump downwards to free stuck equipment.

BACKGROUND OF THE INVENTION

In the oilfield, equipment occasionally becomes stuck in a well. A stuck object or "fish" may either be part of a drilling string which became stuck during drilling of an oil well, or it may be production equipment being removed from an existing well bore during workover operation.

The oilfield jar is a tool used when either drilling or production equipment has become stuck to such a degree that pulling from the surface is not sufficient to dislodge the stuck components. The jar is placed in the drill string in the general region of the stuck object. It allows operation of the rig at the surface to cause an impact to be delivered to the wellbore string in the area of the stuck fish. The jar incorporates a pair of telescoping tubular parts which contain a time delay mechanism, so that the drill string can be stretched prior to the parts moving relative to each other. Each of the telescoping parts carries an impact surface, which are brought together rapidly once the drill string has been stretched and the parts are free to move relative to each other. This causes an impact or jar to occur which is transmitted to the stuck fish. Jars may be double acting units with a second pair of impact faces so that they may deliver a jar upwardly and a bump or jar downwardly, as is known in the art. Such a tool is referred to as a bumping and jarring tool.

In practice, there are two types of oilfield jars commonly used: the mechanical jar and the hydraulic jar. They differ in how the required time delay is achieved.

The mechanical jar comprises two telescoping parts and a mechanical latching system. The latching system restrains the parts from telescoping until a certain load is exceeded. For example, in a 6¾" mechanical drilling jar, the tripping load may be 60,000 lbs. force. Of course, in order to cause the latch to release, the operator must pull up on the drill string an amount equal to the weight of the drill string above the jar plus the tripping load of the jar. When the tripping load is applied, the mechanical latch releases and the members are rapidly extended with respect to each other, causing the impact faces to strike.

Mechanical jars are not versatile. The tripping load is preset at the surface and cannot be changed satisfactorily while the tool is downhole. Mechanical jars have been designed which require torque to be applied from the surface through the pipe to the tripping mechanism. This gives some variability as to the tripping load, but it can be dangerous to rig floor personnel and it is difficult to control the tripping load.

As well, mechanical jars have the disadvantage that wear of the latch components causes variation in the tripping point, and failures of the moving parts occur with regularity. The cost of manufacture and maintenance of mechanical jars is also high.

However, mechanical jars do afford the advantage that the jar can be rapidly fired and reset. Also, because they fire at a preset level, the impact delivered to the fish is known. Further, mechanical jars will not accidentally fire while tripping in or out of a hole.

The second type of oilfield jar commonly used is the hydraulic jar. The hydraulic jar has two telescoping parts with an internal liquid-holding space. Fluid is metered slowly from one chamber to another in the liquid-holding space when axial pull is applied to the tool. The rate at which the fluid is metered depends upon the load on the tool. Thus, a variation in impact can be attained at the discretion of the operator. Hydraulic jars are preferred in crooked holes, in which it is difficult to apply high tripping loads. Stated otherwise, if it is only possible to apply a low tensile pull to the tool due to contact of the drill string with the wellbore wall, the tool will still eventually fire (although with low impact).

Disadvantages of the hydraulic jar include that it may accidentally fire when being tripped in or out of a well. This can be dangerous to personnel. If excessive force is applied at a rapid rate, the hydraulic chamber wall can rupture. The jar cannot be fired as quickly as a mechanical jar. And finally, there is some uncertainty as to when it will fire and at what impact.

With this background in mind, it is the object of the present invention to provide a hybrid hydraulic/mechanical jarring and bumping tool that incorporates the dual capacities of being able:

- to consistently and quickly fire at a pre-determined tensile load applied at the tool; and yet
- still fire (although with a longer time delay) if the pre-determined tensile load does not reach the tool.

SUMMARY OF THE INVENTION

The invention involves providing a tool which incorporates a tubular mandrel and barrel in telescoping relation, said parts forming an annular space between them that is sealed at its ends and which is filled with operating oil when functioning. The barrel has two full diameter axial sections which cooperate with the mandrel to form axially spaced apart free-stroke chambers separated by a reduced diameter piston-fitting section. The mandrel carries a free-floating, annular, cylindrical primary piston (or sleeve) which sealably engages the barrel piston-fitting section when passing therethrough. A secondary cylinder assembly, preferably comprising a transverse top wall and a downwardly extending, annualar secondary cylinder, is mounted to the mandrel beneath the primary piston. The secondary cylinder is radially spaced between the mandrel and barrel walls, to thereby form an annular secondary piston chamber with the mandrel. A port extends down through the transverse wall or projection closing the upper end of the secondary cylinder, whereby fluid communication is established between the annular space above the primary piston and the secondary piston chamber. The primary piston is preferably adapted to seat on and seal against the transverse top wall of the secondary cylinder assembly. But in doing so, the port is left open. A free-floating, annular, cylindrical secondary piston is disposed in the upper end of the secondary piston chamber. The secondary piston sealably engages the mandrel and secondary cylinder assembly walls. A preferably annular spring element is positioned in the secondary piston chamber beneath the secondary piston and extends around and down the mandrel. The top end of the spring element engages the secondary piston. The lower end of the spring element is supported by a stop shoulder extending radially from the mandrel. The mandrel and barrel carry conventional hammer and anvil shoulders, adapted to impact together at the ends of each of the jarring and bumping strokes.

Thus, when axial tensile pull is applied to the mandrel by the rig lifting the drill string, the primary piston enters the barrel piston-fitting section and compresses the operating oil in the upper free-stroke chamber. The oil then seeks to escape through the port and enters the secondary piston chamber, thereby biasing the secondary piston downwardly and compressing the spring element. The increasing resistance of the spring element retards the upward axial advance of the primary piston through the piston-fitting section of the barrel wall, thereby enabling the rig to stretch the drill string. As this progresses, the fluid pressure in the upper free-stroke chamber rises and the spring element is shortened, until the upwardly moving primary piston clears the piston-fitting section. At this point, the tool is tripped or fires. More particularly, the primary piston is now fully in the upper free-stroke chamber, the oil may move freely down around the outside of the primary piston, the mandrel accelerates upwardly as the stretched drill string contracts and the jarring anvil and hammer shoulders impact at the end of the stroke to deliver an upward jar to the drill string. At the same time, the hydraulic fluid pressure drops, the spring element lengthens and the secondary piston returns to its starting position.

To re-set the tool for another jarring stroke, the mandrel is lowered. The free-floating primary piston is lifted from its sealing engagement on the transverse top wall of the secondary cylinder assembly and a bypass passage "behind" the primary piston opens, to allow fluid to move upwardly as the primary piston is lowered through the barrel piston-fitting section.

From the foregoing it will be noted that the tripping load is determined by the spring constant of the spring element and the diameter of the secondary piston.

This "mechanical" tripping load is pre-determined and consistently the same on each jarring stroke. Thus the present tool is able to emulate this desirable feature of a mechanical jar.

If desired, one can incorporate metering ports extending axially through the primary piston, to allow the tool to jar more slowly at a tripping load that is less than the previously described mechanical tripping load.

In this latter embodiment, one can repeatedly jar in short cycles at a constant mechanical tripping load, provided that the drill string can transmit the necessary tensile pull to the tool. However, if this is not possible, one can still jar more slowly and with less impact at tripping loads beneath the mechanical tripping load, by relying on the metering ports.

To this point, the tool has been described in the context of jarring. However, by preferably adding the second or lower free-stroke chamber and the second pair of impact faces, one can jar downwardly repeatedly by pulling the mandrel up until the primary piston just enters the barrel piston-fitting section, and then dropping the drill string and mandrel to enable them to fall freely until the bumping hammer and anvil contact, thereby delivering a downward jar. This concept (of free fall bumping) is old, but not in the context of a tool having the described jarring capability.

The tool is characterized by the following advantages:

It is a hydraulically controlled and actuated jar that can fire at a pre-set mechanically-controlled tripping load;

It preferably can independently and selectively jar up or bump down;

It preferably can fire at or below the pre-set mechanically-controlled tripping load; and It is not subject to overloading.

Broadly stated, the invention is a jarring tool for use in a drilling string, said tool comprising a tubular mandrel and barrel arranged in telescoping relation and forming an annular space between them for containing operating liquid, said parts having means sealing the annular space at its ends, said parts having at least one pair of anvil and hammer shoulders for impacting at the completion of a jarring stroke, the improvement comprising said barrel having an inner surface forming an upper free-stroke section of full diameter and a contiguous reduced diameter piston-fitting section therebelow, said free-stroke section combining with the mandrel to form a free-stroke chamber; said mandrel carrying a secondary cylinder assembly having a transverse top wall and a downwardly extending annular cylindrical wall forming an annular piston chamber; an annular free-floating primary piston mounted on the mandrel, said primary piston being adapted to seat on and seal against the secondary cylinder assembly and, when opposite the piston-fitting section, to seal against said section, an annular secondary piston positioned in the upper end of the piston chamber and adapted to seal against the mandrel and cylindrical wall; a spring element supported at its lower end by a stop secured to the mandrel and abutting the secondary piston at its upper end; said secondary cylinder assembly top wall forming a port providing communication between the free-stroke chamber and the piston chamber; said primary piston and mandrel combining to form a bypass passage adapted to provide communication between the free-stroke chamber and the annular space below the primary piston when said piston is unseated.

DESCRIPTION OF THE PREFERRED EMBODIMENT

Figure 1:
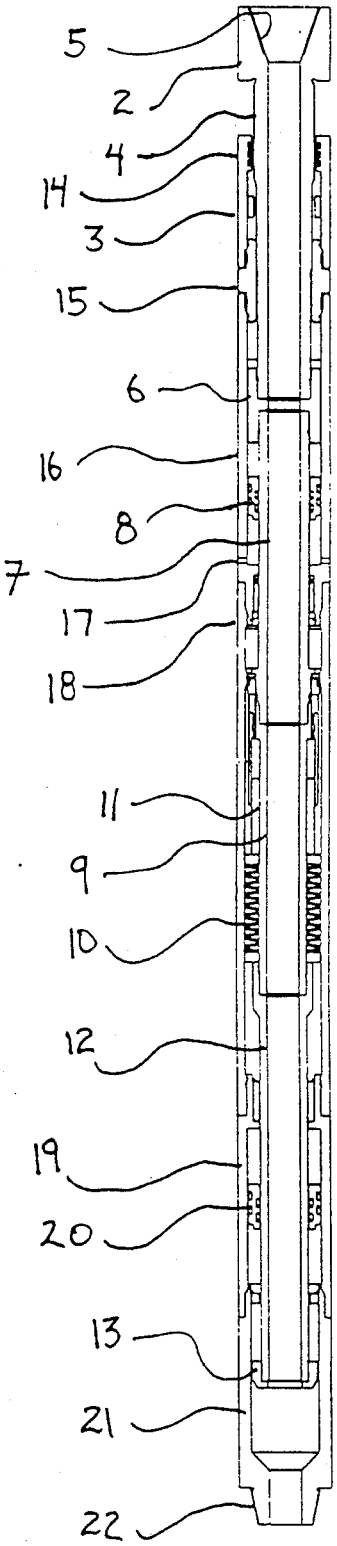
FIG. 1 is a cross-sectional view of a preferred embodiment of the tool at the beginning of the power stroke phase.
Figure 2:
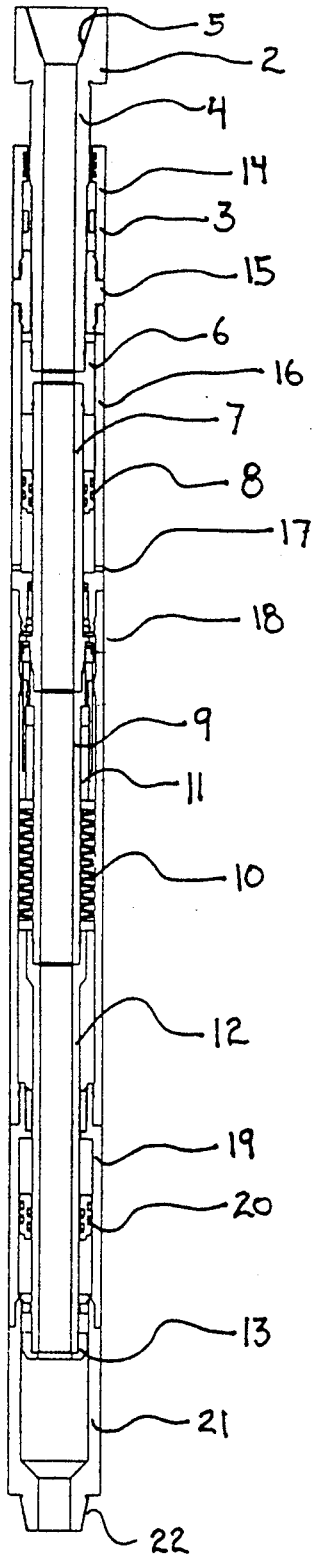
FIG. 2 is a cross-sectional view of the embodiment of the tool in FIG. 1 in the impact phase with the jar fully open.
Figure 3A:
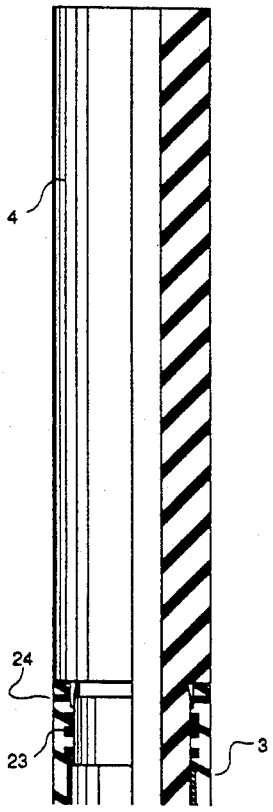
FIGS. 3*a*, 3*b*, 3*c*, and 3*d* are detailed cross-sectional views of the embodiment of the tool in FIG. 1 at the bottom of the bumping stroke with the tool fully closed.
Figure 4A:
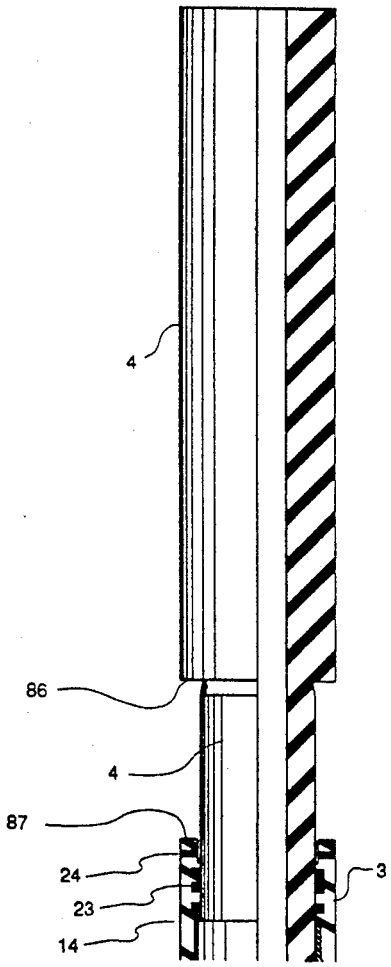
FIGS. 4*a*, 4*b*, 4*c* and 4*d* are detailed cross-sectional views of the embodiment of the tool in FIG. 1 at the beginning of the power stroke phase.
Figure 5A:
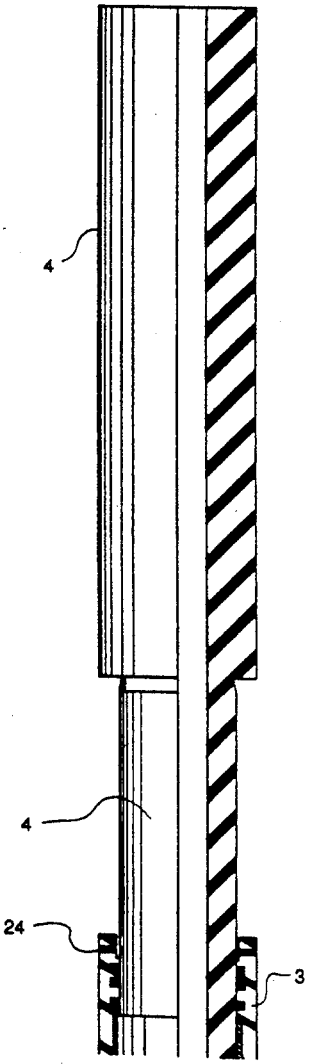
FIGS. 5*a*, 5*b*, 5*c* and 5*d* are detailed cross-sectional views of the embodiment of the tool in FIG. 1 in the impact phase with the jar fully open.
Figure 3B:
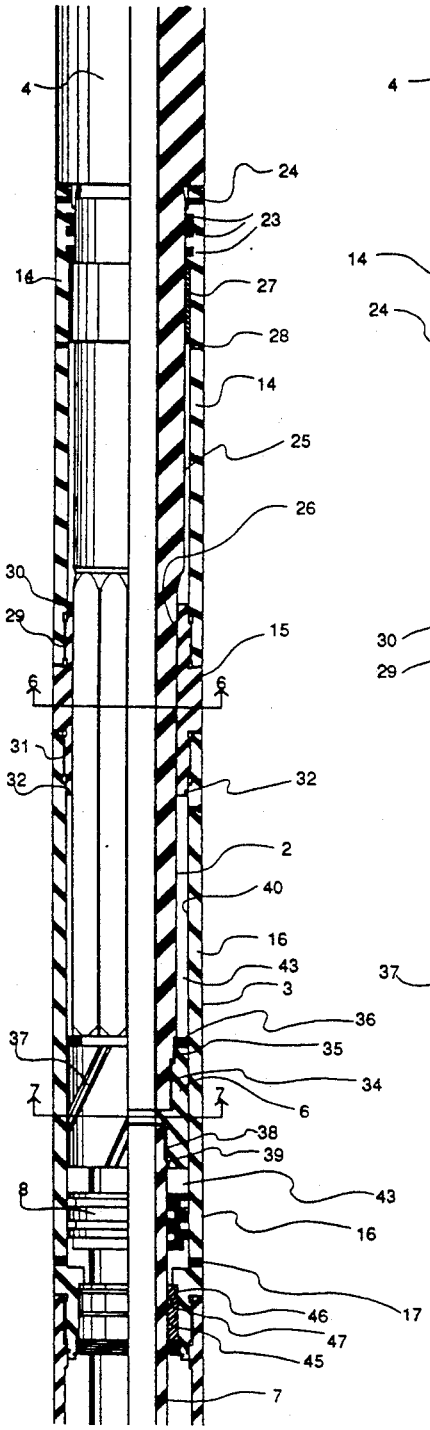
Figure 4B:
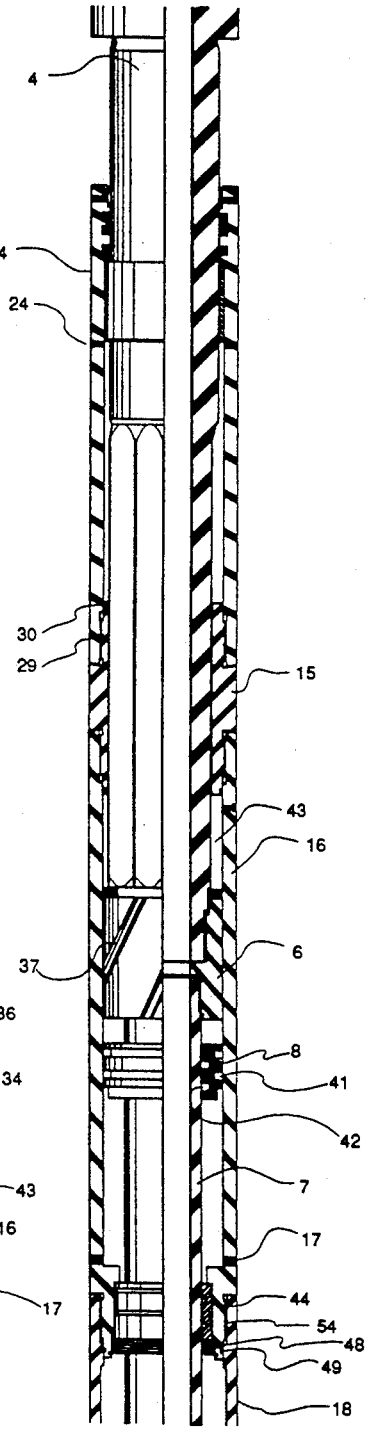
Figure 5B:
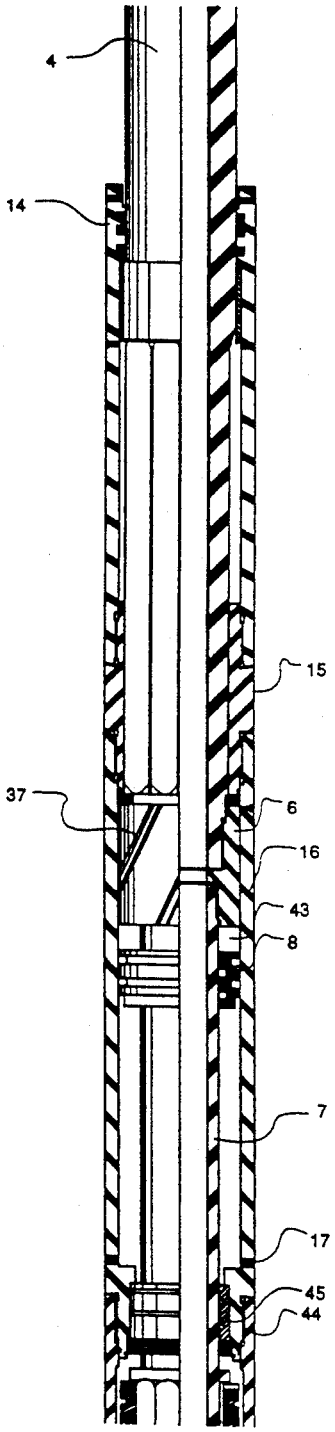
Figure 3C:
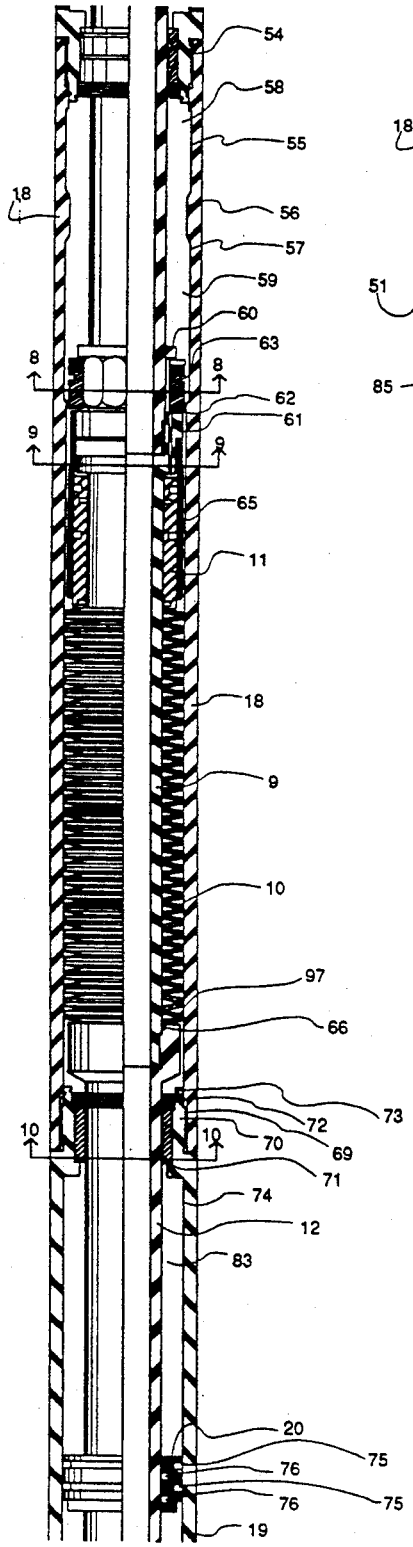
Figure 4C:
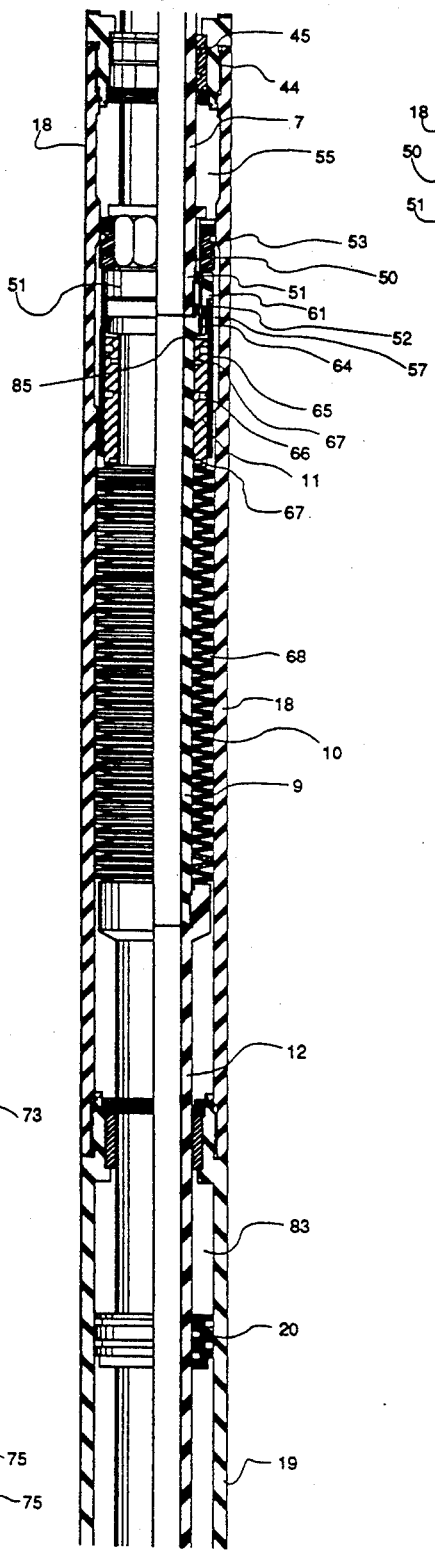
Figure 5C:
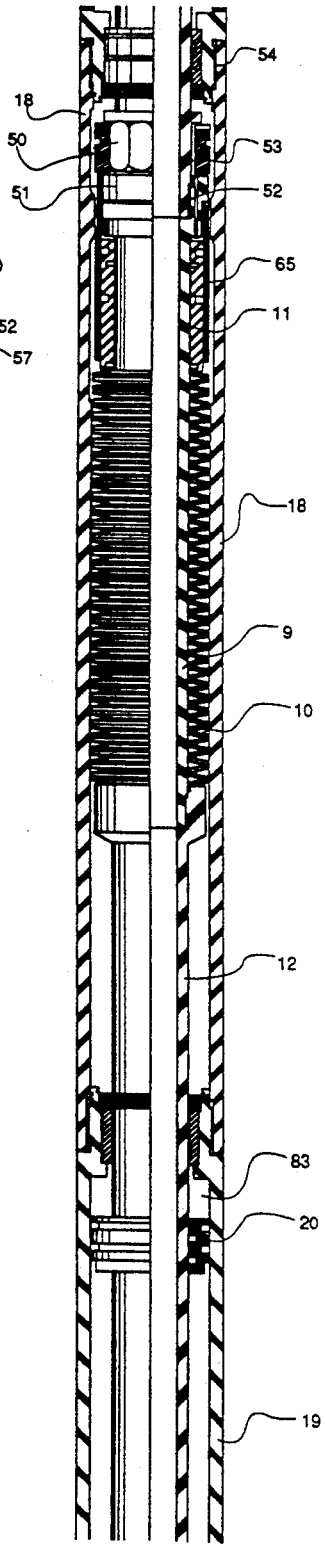
Figure 3D:
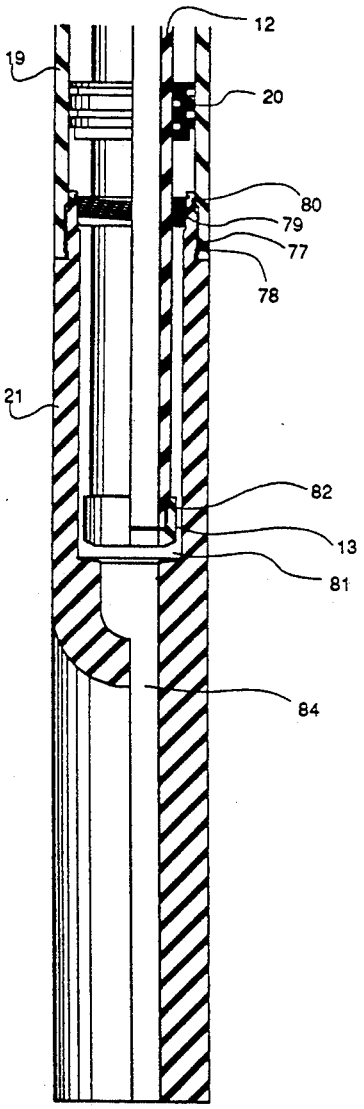
Figure 4D:
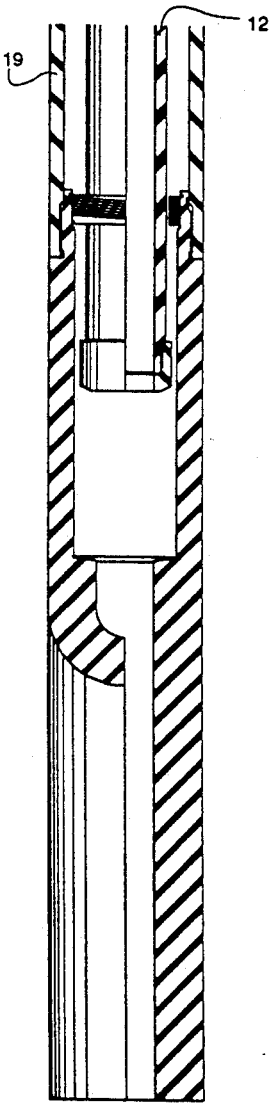
Figure 5D:
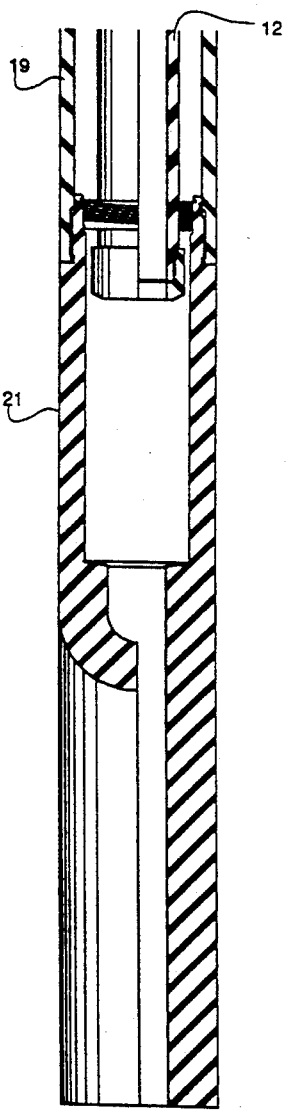

According to the present invention, the tool is indicated generally as 1. Referring to FIGS. 1 and 2, the tool 1 comprises a tubular mandrel 2, telescoped within a tubular barrel 3. Each of the mandrel and barrel 2 and 3 comprise a plurality of parts as follows.

From top to bottom, the mandrel 2 has an upper mandrel segment 4 which has an enlarged upper portion with a female tool thread 5 for connection to a drill string (not shown). The upper mandrel segment 4 is threadably connected to an impact element, the knocker member 6. The knocker member 6 is threadably connected to a middle mandrel segment 7 which carries a free-floating seal 8. The middle mandrel segment 7 is threadably connected to a lower mandrel segment 9, which carries a spring 10 and a free-floating, annular, cylindrical secondary piston 11. The lower mandrel segment 9 is in turn threadably connected to a wash-pipe member 12 which has a cap 13 threadably attached.

Figure 6:
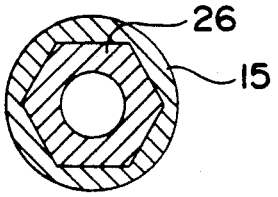
FIG. 6 is a cross-sectional view of the tool along line 6—6 of FIG. 3*b;*
Figure 7:
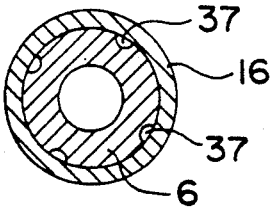
FIG. 7 is a cross-sectional view of the tool along line 7—7 of FIG. 3*b;*
Figure 8:
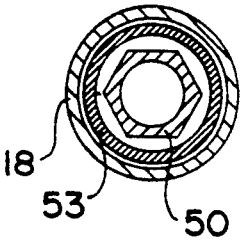
FIG. 8 is a cross-sectional view of the tool along line 8—8 of FIG 3*c;*
Figure 9:
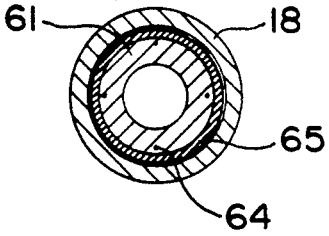
FIG. 9 is a cross-sectional view of the tool along line 9—9 of FIG. 3*c.
Figure 10:
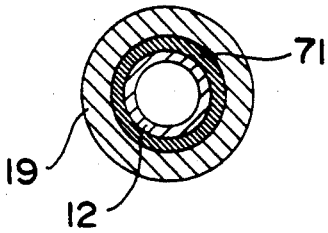
* and FIG. 10 is a cross-sectional view of the tool along line 10—10 of FIG. 3*c*.

From top to bottom, the barrel assembly 3 has a seal cap member 14 which seals with the upper mandrel segment 4 of the mandrel 2. The seal cap member 14 is threadably connected to a female spline member 15 which interlocks with a splined portion of the upper mandrel segment 4 of the mandrel 2, as shown in FIG. 6 and described further below. The female spline member 15 is threadably connected to an upper barrel segment 16 which is equipped with a plurality of ports 17 adjacent its lower end. The upper barrel segment 16 is threadably connected at its lower end to a lower barrel segment 18, which contains the operating fluid chamber of the tool, described further below. The lower barrel segment 18 is threadably connected to a floating seal sub 19, which contains a floating seal 20 which seals with the wash-pipe member 12. At its lower end, the floating seal sub 19 is threadably connected to a tool sub 21 which terminates in a tool joint 22, for connection to a drill string (not shown).

Referring now to the detailed drawings, FIGS. 3*a*, 3*b*, 3*c* and 3*d* are detailed cross-sectional views of the tool 1 from top to bottom at the bottom of the bumping stroke with the tool fully closed. FIGS. 4*a*, 4*b*, 4*c* and 4*d* are similar views, but at the beginning of the impact phase. Likewise, FIGS. 5*a*, 5*b*, 5*c* and 5*d* are of the impact phase with the tool fully open. FIGS. 6 to 10 are cross-sectional views at indicated points. The tool will now be described in detail from top to bottom with reference to these FIGURES.

As noted, the upper mandrel segment 4 has an upper female tool thread 5 for connection to a drill string (not shown). The seal cap member 14 of the barrel 3 is sealed to the upper mandrel segment 4 by a plurality of seals 23. A plurality of ports 24 are formed in the seal cap member 14 at its upper end above the seals 23. Below the tool thread 5 of the upper mandrel segment 4 is a highly finished, preferably chromed section 25 extending down to a splined section 26. Below the seals 23 and interior of the seal cap 14 is a stabilizer ring 27, which slidably receives the mandrel section 25. Below the stabilizer ring 27 is a plurality of filler holes 28, to receive retainers (not shown) to locate the stabilizer ring 27.

The splined section 26 of the upper mandrel segment 4 has a hexagonal cross-section which mates with the female spline member 15, as shown in FIG. 6. Fluid flow passages (not shown) are provided to allow free flow of fluid between the mandrel 2 and barrel 3, across the female spline member 15. The lower end of the seal cap member 14 is threaded at 29 to receive the top of the spline member 15. The spline member 15 has a seal ring and seal 30. Likewise, the upper end of the upper barrel segment 16 is threaded at 31 to receive the bottom of the spline member 15, with a seal ring and seal 32 provided.

The upper mandrel segment 4 ends in a threaded male section 34 for connection to the knocker member 6. The knocker member 6 is provided with a seal 35 and has a knocker plate 36 adjacent its upper end. The knocker member 6 serves as a stabilizer in the upper barrel segment 16, as shown in cross-section in FIG. 7. A plurality of spiral grooves 37 are formed on the exterior of the knocker member 6 to allow free flow of fluid across the knocker member 6. The knocker member 6 is provided with a threaded section 38 and a seal 39 at its lower end for attachment to the middle mandrel segment 7.

The upper barrel segment 16 has an inner smooth bore housing 40. Contained between the upper barrel segment 16 and the middle mandrel segment 7 is the floating seal 8, provided with external seals 41 and internal seals 42. Thus, an upper spline chamber 43 is formed between the mandrel assembly 2 and the barrel assembly 3, contained at its upper end by seals 23 of the seal cap member 14, and at its lower end by the floating seal 8. The upper spline chamber 43 is filled with clean lubricating oil (not shown) which maintains the spline surfaces 15 and 26 in functional condition. The floating seal 8 equalizes the pressure of the oil in the chamber 43 with the fluid pressure external of the tool by means of the ports 17.

A threaded connection 44 is provided at the lower end of upper barrel segment 16, with an internal packing gland 45 provided with exterior seals 46 and interior seals 47. At the end of the packing gland 45 is a threaded locator ring 48 which is held in place by a snap ring 49.

The middle mandrel segment 7 has a smooth, preferably chromed, exterior surface which passes through both the floating seal 8 and the packing gland 45 of the upper barrel segment 16. The middle mandrel segment 7 terminates with a hexagonal section 50 followed by a cylindrical section 51 and a threaded male joint 52. Carried on the hexagonal section 50 is a primary piston 53, which is slideably received on the hexagonal section 50, as shown in cross-section in FIG. 8.

The lower barrel segment 18 has an upper threaded section 54 for connection to the threaded connection 44 of the upper barrel segment 16. Below the upper threaded section 54, the inner surface of the lower barrel segment 18 forms a full diameter upper section 55, a middle piston fitting section 56 of relatively reduced diameter, and a full diameter lower section 57. The upper and lower sections 55 and 57 and the mandrel 2 form upper and lower free-stroke chambers 58 and 59, respectively. The piston fitting section 56 of the lower barrel segment 18 sealably engages the primary piston 53. Together, sections 55, 56 and 57 form an operating cylinder for the primary piston 53.

A stop 60 is provided on the middle mandrel segment 7 to limit upward travel of the primary piston 53 between the stop 60 and a mandrel projection 61 on the lower mandrel segment 9. Mandrel segments 7 and 9 are threadably connected. A seal 62 is provided between the mandrel projection 61 and the primary piston 53. A seal 63 is provided on the primary piston 53, to seal against the piston fitting section 56. A plurality of ports 64 extend through the mandrel projection 61, as shown in cross-section in FIG. 9.

A secondary cylinder 65 is threadably attached to the lower end of the mandrel projection 61. The secondary cylinder 65 has a chromed interior and the lower portion of the lower mandrel segment 9 has a smooth exterior surface, both for reception of the secondary piston 11. A number of external seals 66 on the secondary piston 11 seal the secondary piston against the secondary cylinder 65. Similarly, a number of internal seals 67 on the secondary piston 11 seal the secondary piston 11 against the lower mandrel segment 9.

The wash pipe segment 12 is threadably connected to the lower mandrel segment 9, a seal 66 being provided to seal the lower mandrel segment 9 to the wash-pipe segment 12. A stop or shoulder 97 at the top of the wash-pipe segment 12 carries the spring 10. The spring 10 biases the secondary piston 11 upwards against the mandrel projection 61. Below the lower section 57 of the lower barrel segment 18 is a section 68 of relatively reduced internal diameter to stabilize the spring 10.

At the lower end of the lower barrel segment 18 is a threaded connection 69 for threadably connecting the lower barrel segment 18 to the floating seal sub 19. A male connection 70 is provided at the upper end of the floating seal sub 19, which has an internal bore to carry stabilizer ring 71. The stabilizer ring 71 is held in place with a threaded ring 72 and a snap ring 73. It provides tool stabilization in the floating seal sub 19, while allowing for fluid transfer across the stabilizer ring 71, as shown in cross-section in FIG. 10.

A relieved bore section 74 below the male connection 70 slidably receives the floating seal 20. The floating seal 20 has external seals 75 to seal with the floating seal sub 19, and interior seals 76 to seal with the wash-pipe segment 12.

At the bottom of floating seal sub 19 is a threaded connection 77 to the tool sub 21. The tool sub 21 is provided with a male connection 78 which carries internally a safety ring 79, threadably received by the interior of the male connection 78 and held in place by a snap ring 80. The interior of the tool sub 21 has a counter bore 81 allowing free movement of the retaining cap 13 threadably engaged on threaded section 82 on the end of the wash-pipe segment 12. The tool sub 21 terminates in the tool joint 22.

A lower operating chamber 83 is formed between the mandrel 2 and the barrel 3, contained at its upper end by the packing glands 45, and at its lower end by the floating seal 20. The floating seal 20 is exposed to internal fluid pressure by a port 84, which connects the floating seal 20 to pressure internal of the drill string. This provides pressurized fluid in the lower operating chamber 83 to prevent distortions of the chamber due to hydrostatic pressure.

In operation, as shown in FIGS. 4*a*, 4*b*, 4*c*, and 4*d*, the tool 1 is at the beginning of the jarring stroke, with the primary piston 53 entering the piston fitting section 56. As the mandrel 2 is extended from the barrel 3, the primary piston 53 is forced into the piston fitting section 56, causing an increase in fluid pressure in the upper free stroke chamber 58. This fluid pressure in the chamber 58 is distributed through the projection ports 64 into the secondary piston chamber 85 containing the secondary piston 11. As load continues to pull the mandrel 2 from the barrel assembly 3, pressure in the upper free-stroke chamber 58 is increased, and the increased pressure is transmitted through the projection ports 64 to the secondary piston chamber 85, where it acts on the upper face of the secondary piston 11. Thus, the secondary piston 11 is biased downwards against the spring 10, causing it to contract against the shoulder 97 of the wash-pipe 12. When a given load, the tripping load, has been applied to extend the mandrel 2 from the barrel 3, the pressure in chambers 58 and 85 will have increased to a level Whereby the biasing of the secondary piston 11 will have compressed the spring 10 to the extent that the primary piston 53 clears the piston fitting section 56 and is fully within the upper free stroke chamber 58. This occurs when the increase in volume of the secondary piston chamber 85 due to the biasing of the secondary piston 11 is equivalent to the displaced fluid of the primary piston 53 moving through the piston fitting section 56.

Firing as above requires a specific tripping load. It is dictated by the spring constant of the spring 10 and the cross-sectional area of the secondary piston 11, related to the cross-sectional area of the primary piston 53.

When the primary piston 53 is free of the piston fitting section 56, the stored energy in the stretched drill string accelerates the primary piston 53 upwards along with the mandrel 2, as shown in FIGS. 5*a*, 5*b*, 5*c* and 5*d*. This causes the knocker member 6 to impact the female spline member 15, thus delivering a jar or impact upwards.

Once the tool has been jarred upwards, the weight on the drill string is released, and the mandrel 2 is lowered into the barrel 3. The primary piston 53 unseats from the mandrel projection 61, allowing free flow of fluid past the primary piston 53 and into the lower free-stroke chamber 59. Thus the tool 1 is reset. It should also be noted that during the jarring stroke, the secondary piston 11 is returned to its initial position by means of the spring energy stored in the spring 10. The spring 10 forces the secondary piston 11 upward and returns fluid from the secondary piston chamber 85 via the ports 64 to the upper free-stroke chamber 58.

If a bumping stroke is required, the mandrel 2 is forced downwards, with primary piston 53 unseating from the mandrel projection 61 to allow free passage of fluid. As shown in FIGS. 3*a*, 3*b*, 3*c* and 3*d*, the primary piston can move freely to the bottom of the stroke. The bumping stroke is delivered when a shoulder 86 of the upper mandrel 4 strikes a shoulder 87 of the seal cap member 14.

The primary piston 53 may have a metering port (not shown) extending axially through it, which allows metering of fluid slowly from the upper free-stroke chamber 58 to the lower free-stroke chamber 59. In this mode, as the mandrel 2 is extended from the barrel 3 by an applied load, fluid pressure will be generated in the upper free-stroke chamber 58, and transmitted via the ports 64 to the secondary piston chamber 85 to bias the secondary piston 11 against the spring 10. If the force is insufficient to cause sufficient fluid to move from the upper free-stroke chamber 58 to the secondary piston chamber 85 to allow the primary piston 53 to clear the piston fitting section 56, in the absence of a metering port, the tool 1 would not fire. With a metering port extending through the primary piston, fluid can bleed slowly from the upper free-stroke chamber 58 into the lower free-stroke chamber 59, until the primary piston 53 clears the piston fitting section 56 to fire the tool 1.

The embodiment of the invention in which an exclusive property or privilege is claimed are defined as follows:

1. In a jarring tool for use in a drilling string, said tool comprising a tubular mandrel and a barrel arranged in telescoping relation and forming an annular space between them for containing operating liquid, said parts having means sealing the annular space at its ends, said parts having at least one pair of anvil and hammer shoulders for impacting at the completion of a jarring stroke, the improvement comprising:

said barrel having an inner surface forming an upper free-stroke section of full diameter and a contiguous reduced diameter piston-fitting section therebelow, said free-stroke section combining with the mandrel to form a free-stroke chamber;

said mandrel carrying a secondary cylinder assembly having a transverse top wall and a downwardly extending annular cylindrical wall forming an annular piston chamber;

an annular free-floating primary piston mounted on the mandrel, said primary piston being adapted to seat on and seal against the secondary cylinder assembly and, when opposite the piston-fitting section, to seal against said section;

an annular secondary piston positioned in the upper end of the piston chamber and adapted to seal against the mandrel and cylindrical wall;

a spring element supported at its lower end by a stop secured to the mandrel and abutting the secondary piston at its upper end;

said secondary cylinder assembly top wall forming a port providing communication between the upper free-stroke chamber and the piston chamber;

said primary piston and mandrel combining to form a bypass passage adapted to provide communication between the free-stoke chamber and the annular space below the primary piston when said piston is unseated.

2. A bumping and jarring tool for insertion in a drill string, comprising:

telescopically arranged tubular parts comprising an outer tubular barrel and an inner tubular mandrel telescopically received within the barrel in spaced relationship with the barrel, so that a liquid-holding space is defined between the parts, the parts being movable longitudinally relative to each other between a collapsed bumping position and an extended jarring position;

upper and lower sealing means for sealing off the ends of the liquid-holding space so that it is adapted to retain a body of operating liquid;

first and second means connecting the mandrel and barrel and preventing relative rotational movement of the mandrel with respect to the barrel, but allowing relative longitudinal movement, the first means and the mandrel forming a first unit, and the second means and the barrel forming a second unit;

means at the upper end of the mandrel for threadably connecting the mandrel to an upper portion of a drill string, and means at the lower end of the barrel for threadably connecting the barrel to a lower portion of a drill string;

the inner surface of a first one of the parts in the liquid-holding space forms an operating cylinder, comprising an upper free-stroke section of relatively large inside diameter, a middle piston section of relatively reduced inside diameter, and a lower free-stroke section of relatively large inside diameter, the upper and lower free-stroke sections of the first part combining with a second one of the parts to define an upper free-stroke chamber and a lower free-stroke chamber, respectively;

a projection formed on the second part in the liquid-holding space, from which a secondary cylinder extends downwardly, the secondary cylinder being in spaced relationship from both of the parts and forming a piston chamber with the second part;

an annular free-floating primary piston, carried by the second part in the liquid-holding space above the projection and in spaced relationship with the second part, said piston being adapted to seat on the projection and seal thereagainst When the second of the parts is moved upwardly, the primary piston being spaced relative to the first of the parts so that the primary piston may freely stroke in the upper and lower free-stroke chambers but seals against the piston section;

stop means associated with the second part for limiting the upward movement of the primary piston with respect to the second part;

an annular free-floating secondary piston carried by the second part and disposed in the piston chamber, said secondary piston being operative to seal against the second part and the secondary cylinder;

spring means carried by the second part on a shoulder on the second part in the lower free-stroke chamber, for biasing the secondary piston upwards toward the projection, with the second part, projection, secondary cylinder and secondary piston forming a fluid-receiving chamber therebetween when the spring means is in a contracted position;

the projection forming at least one port to establish free fluid communication between the upper free-stroke chamber and the fluid receiving chamber, so that as the second part is pulled upwardly and the primary piston enters the piston section, operating liquid in the upper free-stroke chamber is compressed and is forced down through the port to compress the spring means, until the primary piston clears the piston section and the compressed operating liquid is free to pass around the primary piston and secondary cylinder and enter the lower free-stroke chamber, allowing the second part to jar upwards;

a pair of first impact faces, one carried by each of the parts, arranged to contact each other to limit the longitudinal movement of the second part with respect to the first part to the extended, jarring position; and a pair of second impact faces, one carried by each of the parts, arranged to contact each other to limit the longitudinal movement of the second part with respect to the first part to the collapsed bumping position.

3. The tool as set forth in claim 2, in which the first one of the parts is the barrel and the second one of the parts is the mandrel.

4. The tool as set forth in claim 1 wherein the free-floating primary piston is provided with fluid metering means.

5. The tool as set forth in claim 2 wherein the free-floating primary piston is provided with fluid metering means.

* * * * *